United States Patent [19]

Beerens et al.

[11] 4,000,625

[45] Jan. 4, 1977

[54] METHOD OF COOLING A MOVING STRAND OF HOT MATERIAL

[75] Inventors: Hugo Beerens, Meerbusch; Hugo Feldmann, Hoengen; Claus Georg Schlanzke, Ratingen-Tiefenbroich, all of Germany

[73] Assignee: Schloemann-Siemag Aktiengesellschaft, Dusseldorf, Germany

[22] Filed: Dec. 3, 1974

[21] Appl. No.: 529,233

[30] Foreign Application Priority Data

Dec. 7, 1973 Germany ..... 2361042

[52] U.S. Cl. ..... 62/63; 72/201; 164/89; 164/283 S; 266/114

[51] Int. Cl.[2] ..... F25D 13/06

[58] Field of Search ..... 266/4 A, 4 S, 6 S; 62/63, 373, 374, 375, 376; 164/89, 283 S; 72/201

[56] References Cited

UNITED STATES PATENTS

| | | | |
|---|---|---|---|
| 2,287,825 | 6/1942 | Postlewaite | 62/63 X |
| 2,624,178 | 1/1953 | Bedson | 62/63 |
| 3,428,726 | 2/1969 | Moss | 62/63 X |
| 3,861,597 | 1/1975 | Tsukamura et al. | 266/6 S X |
| 3,897,230 | 7/1975 | Taylor et al. | 164/89 X |

*Primary Examiner*—William E. Wayner
*Assistant Examiner*—Ronald C. Capossela
*Attorney, Agent, or Firm*—Holman & Stern

[57] ABSTRACT

Water-cooling tubes are extensively used for cooling hot moving strands, for instance hot-rolled rod. In order to avoid the braking action of the water within the tubes, the invention provides for the water to be expelled from the tubes before the leading end of the strand passes through the tubes, by blowing air into the tubes.

5 Claims, 3 Drawing Figures

1
2
3
4
5
6
7
8
9
10
11
12
13
14
15
16
17
18
19
20
21
22

METHOD OF COOLING A MOVING STRAND OF HOT MATERIAL

BACKGROUND OF THE INVENTION

The present invention relates to a method of cooling a moving strand of hot material in which the strand is passed through a plurality of cooling tubes and is water cooled while it passes through the tubes. The strand may be, for instance, hot-rolled rod or an extrusion coming from an extruder and passing through a cooling apparatus at speeds above 35 meters/second.

When rolling rod, such cooling tubes, known as a water-cooling section, are positioned directly after the last or finishing roll stand of the rod mill in order to cool the rod down as quickly as possible to the temperature desired for the proper heat treatment of the rod, before the rod reaches the reel. The cooling should not be too rapid, otherwise excessive temperature gradients would be set up between the core and the surface of the rod, and the difference in temperatures could lead to different transformations and non-uniform structure across the section of the rod; in addition, the temperature should not fall below about 500° C in order to avoid the risk of martensite formation.

One way of carrying out the method is to pass a flow of water through the cooling tubes, but a disadvantage of this method is that the leading end or tip of the rod encounters a high braking resistance due to the dynamic pressure of the water in the cooling tube; the leading end buckles slightly and the rod is thrust against the wall of the tube, leading to increased friction. In this way, the rod sometimes breaks out of the water-cooling section.

In order to avoid the braking action of the water on the leading end of the rod, it is possible to admit water to the cooling tube only after the leading end of the rod has been introduced; however, with the current high rod speeds, this method suffers from the disadvantage that the first fifty to a hundred meters of each rod are cooled in an uncontrolled manner and must be rejected because they have a non-uniform structure and have a thicker layer of mill scale.

THE INVENTION

The invention provides for the water to be expelled from the tubes before the leading end of the strand passes through the tubes, by blowing air into the tubes.

By blowing air into the tubes, and thus expelling water from the tubes, the back pressure acting upon the leading end of the strand can be practically eliminated, at least in the tubes themselves.

When the tubes are only partly cleared of water by the air blast, a water/air mixture will be formed. This mixture will not retard the strand in the way that water alone would, because the presence of the air allows the mixture to be compressed to allow the strand to pass. None the less, because the tubes are immersed in at least one container, there will be water between the tubes, and the leading end of the strand will draw this water into the tubes so that the full cooling effect is resumed automatically, without any substantial delay. Although the leading end will encounter the water remaining between the tubes, the braking effect of this water is not so important, because the dynamic pressure of the water is less since it is not confined by a tube at these positions. Thus the invention can provide uniform cooling and a uniform structure substantially along the whole length of the strand.

An apparatus for performing the method does not require costly pumps, water supply fittings and valves for introducing the cooling water into the cooling tubes at a precise moment, due to the automatic entrainment of the water into the tubes by the strand. In addition, the filters for the cooling water which are required with some water-cooling sections are not necessary using the invention. Thus the apparatus used to perform the inventive method can have a simple structure and be robust, none the less achieving a precise cooling action over a wide range of speeds and temperatures, at low operating cost.

Air may be continuously blown into the tubes at such a pressure that there is little or substantially no water in the tubes when the strand is not passing through the tubes, but the strand is able to draw substantial amounts of water into the tubes when the strand is passing through the tubes. In this way, the water is expelled from the tubes immediately the preceding strand has run out, so that the succeeding leading end cannot be retarded by water in the tubes. In general, there can be a current of water passing through the tubes, and it is found that the pressure of the air should be less than the pressure of the water in the respective tubes, the pressure of the water being both hydrostatic and dynamic.

The air pressure can be so controlled such that a water/air mixture is formed in the tubes when the strand is passing through the tubes; this water/air mixture is used for the cooling operation, thereby preventing excessive cooling of the strand and avoiding the necessity for having special uncooled recovery sections. By avoiding special recovery sections, one achieves good utilization of the space which is available in the factory for cooling purposes.

The tubes can be provided with compressed air inlet ports at the strand entry end, with the ports arranged so that the air flows in the direction of the path of the strand. Thus a water/air mixture is produced in the tubes.

The amount of water required in the container(s), and thus the capacity of the container(s), may be limited by having the or each container form part of a cooling circuit which includes means for controlling the temperature of the water. This also enables the temperature of the cooling water and the rate of cooling to be controlled more precisely, and an inexpensive low-capacity pump may be included in the cooling water circuit, for circulating the cooling water.

Where there are two or more containers, any particular grouping of tubes can be mounted in respective containers, and if desired, each container may have its own cooling water circuit. In this way, the containers can be used for strand paths which are inclined to the horizontal, either rising or falling, without having to be excessively deep, and the direction of travel of the rod (and the orientation of the guide tubes) can be altered without increasing the capacity of the containers. In addition, the cooling water temperature for each container can be adjusted and controlled in accordance with the diameter or cross-sectional are of the strand and the material of the strand, in order to achieve optimum cooling. If necessary, one container may not be supplied with water to serve as a recovery section.

Another way of achieving a given cooling curve or gradient is to adjust and control the pressure of the air supplied to individual cooling tubes groups of or cooling tubes, and in general the apparatus for performing the method can include a device for adjusting and controlling the pressure of the air blown into the tubes. This can achieve the cooling referred to above by means of a water/air mixture.

BRIEF DESCRIPTION OF THE DRAWINGS

The invention will now be further described, by way of example, with reference to the accompanying drawings which show apparatus for performing the method, in which.

DETAILED DESCRIPTION OF ONE EMBODIMENT OF THE INVENTION

Figure 1:
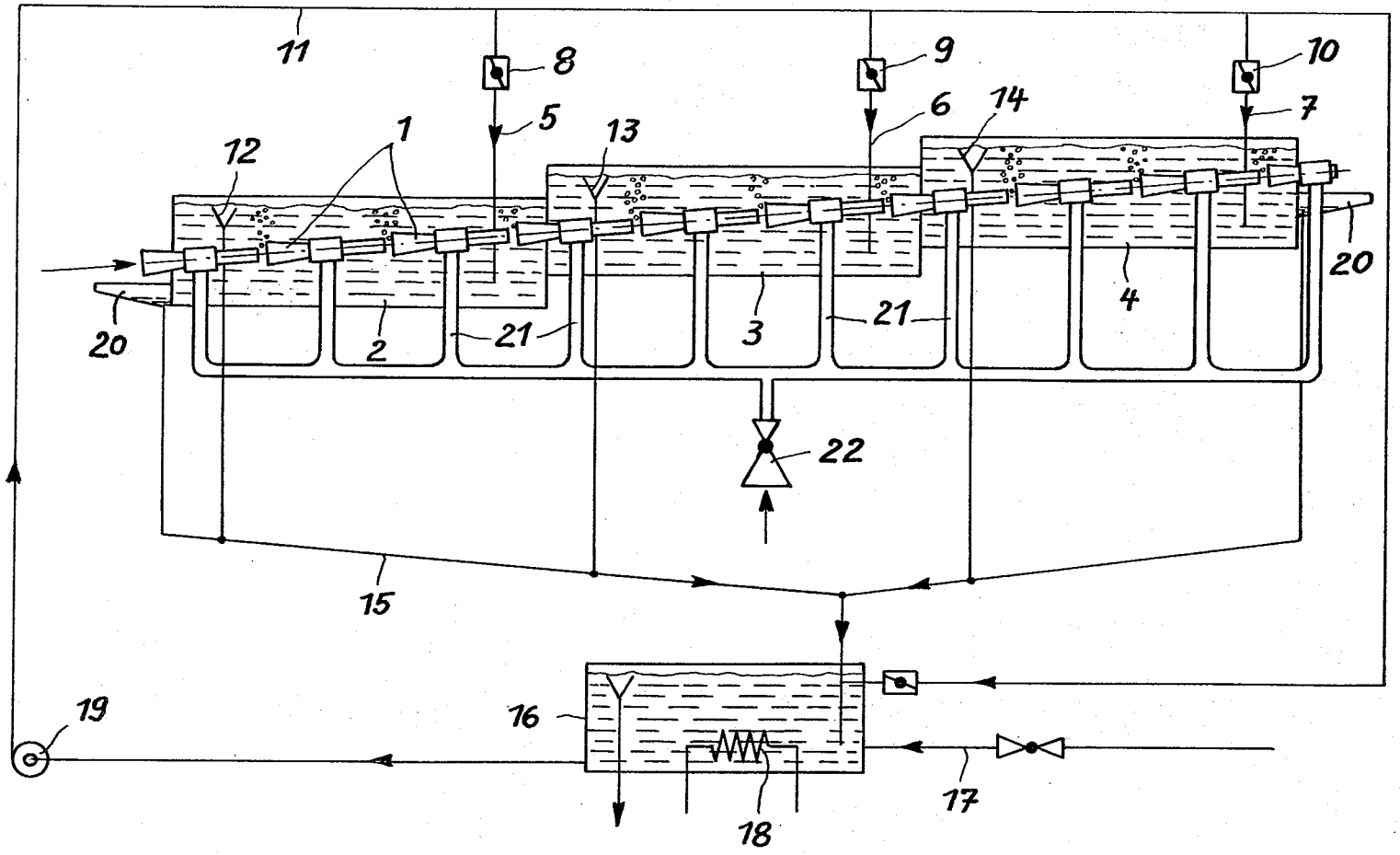
FIG. 1 is a diagrammatic elevational view of a rod cooling section positioned after the last roll stand of a rolling mill.

The rod cooling section, shown in FIG. 1, consists of a plurality of spaced cooling or guide tubes 1 whose input end portions are funnel-shaped. The cooling tubes 1 are located in three containers in the form of tanks 2, 3, 4 which are mutually offset vertically for the purpose of adjustment to the slope of the cooling section.

Each tank 2 3, 4 has a respective upper water inlet 5, 6, 7 each of which is connected by a respective valve 8, 9, 10 to a cooling water circuit 11. Each tank 2, 3, 4 is more over provided with a respective overflow 12, 13, 14. The overflows 12, 13, 14 are connected to a cooling water reflux line 15, which leads to a temperature control device 16 inserted in the cooling water circuit. The temperature control device is provided with a cooling water supply 17 for the purpose of replenishing or recharging the circuit. The temperature of the water may be controlled by the supply of cooling water and by heating means in the form of a coil 18 employing steam or heated water. A pump 19 feeds the cooling water from the temperature control device to the tanks 2, 3, 4. Traps 20 are provided on the inlet of tank 2 and on the outlet of tank 4.

Each cooling tube 1 is provided with a compressed air connection 21, through which air is blown in at low pressure. In this way the water is expelled from the guide tube 1 prior to the introduction of the leading end of the rod, thereby facilitating the introduction of the leading end. The rod, when passing from one guide tube 1 to the next, draws in water from the intervening gaps initially in counterflow to the air which in the embodiment is continually blown in. Since the quantity of water drawn in is dependent on the opposing air pressure, the proportion of air and water which is required to achieve the desired rate of cooling can be adjusted with a pressure regulator 22.

An additional or alternative method of controlling the cooling is to keep one or two of the tanks 2, 3, 4 free of water by closing the respective valves 8, 9, 10 so that the tank or tanks can serve as a recovery section for the rod.

Figure 2:
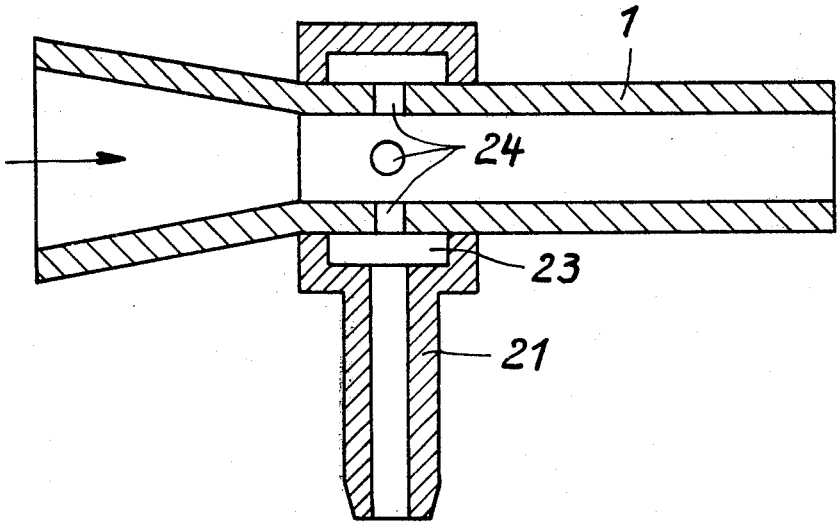
FIG. 2 is a section through a guide tube with a central air entry port.

The guide tube 1, illustrated in FIG. 2, is provided with a central compressed air inlet port 21 which leads into the tube 1 through an annular surrounding channel 23. Bores 24 lead from the channel 23 into the inner space of the tube. Air blown in to this tube displaces the water inside on both sides of the port, provided that the tube is set up horizontal.

Figure 3:
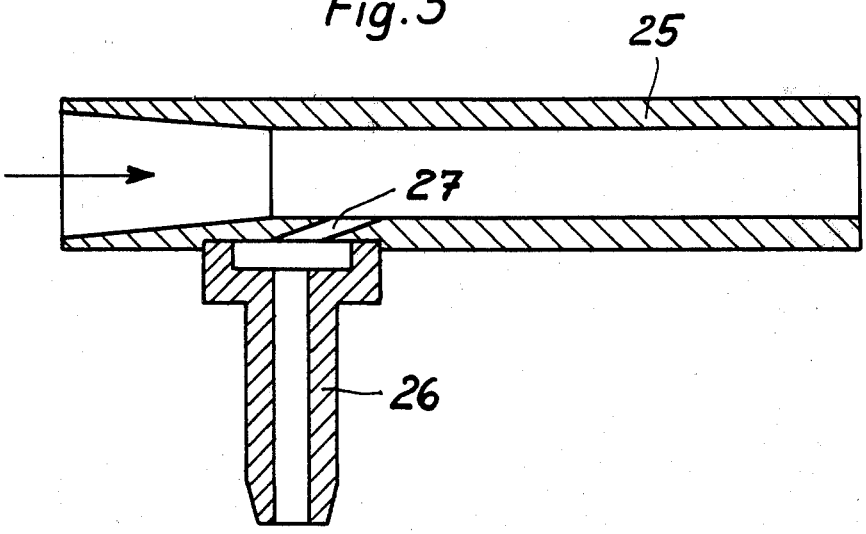
FIG. 3 is a section through tube with an air entry port arranged at the wire entry end.

The guide tube 25, shown in FIG. 3, has a compressed air inlet port 26 arranged at the rod entry end A bore 27 is provided in the tube wall, and this is inclined in the direction of the rod movement through the tube (indicated by an arrow). The compressed air entering the tube mixes with the water already in the tube and the resultant water/air mixture flows towards the exit end of the tube. Because this air/water mixture is compressible, the resistance to the entering rod tip is considerably reduced. The operation of this guide tube 25 is independent of its angle to the horizontal.

We claim:

1. In a method of cooling a moving strand of hot material, comprising the steps of: passing the strand through a plurality of aligned cooling tubes in at least one container containing water in which the tubes are immersed; and water-cooling the strand while the strand passes through the tubes, the improvement comprising the step of: expelling at least a part of the water present in the tubes before the leading end of the strand passes through the tubes by blowing air into the tubes.

2. The method as claimed in claim 1, wherein the air is continuously blown into the tubes at such a pressure that there is substantially no water in the tubes when the strand is not passing through the tubes.

3. The method as claimed in claim 1, wherein a current of water is passed through the tubes, and the air is continuously blown into the tubes at a pressure less than the pressure of the water in the tubes.

4. The method as claimed in claim 1, wherein a water/air mixture is formed in the tubes when the strand is passing through the tubes.

5. The method as claimed in claim 1, further comprising the step of controlling the temperature of the water.

* * * * *